US008394245B2

(12) United States Patent
Ozaki et al.

(10) Patent No.: US 8,394,245 B2
(45) Date of Patent: Mar. 12, 2013

(54) PRODUCTION APPARATUS FOR ELECTRO-DEPOSITED METAL FOIL, PRODUCTION METHOD OF THIN PLATE INSOLUBLE METAL ELECTRODE USED IN PRODUCTION APPARATUS FOR ELECTRO-DEPOSITED METAL FOIL, AND ELECTRO-DEPOSITED METAL FOIL PRODUCED BY USING PRODUCTION APPARATUS FOR ELECTRO-DEPOSITED METAL FOIL

(75) Inventors: Yusuke Ozaki, Ageo (JP); Akira Kunimatsu, Fujisawa (JP)

(73) Assignee: Permelec Electrode Ltd., Kanagawa (JP)

( * ) Notice: Subject to any disclaimer, the term of this patent is extended or adjusted under 35 U.S.C. 154(b) by 389 days.

(21) Appl. No.: 12/751,055

(22) Filed: Mar. 31, 2010

(65) Prior Publication Data

US 2010/0255334 A1 Oct. 7, 2010

(30) Foreign Application Priority Data

Apr. 1, 2009 (JP) ..... 2009-089528

(51) Int. Cl.
*C25D 17/10* (2006.01)
*C25D 17/12* (2006.01)

(52) U.S. Cl. ..... 204/206; 204/280; 205/137

(58) Field of Classification Search ..... 205/137; 204/206, 280

See application file for complete search history.

(56) References Cited

U.S. PATENT DOCUMENTS 5,326,455 A 7/1994 Kubo et al.
5,626,730 A 5/1997 Shimamune et al.
5,628,892 A * 5/1997 Kawashima et al. ..... 205/77

FOREIGN PATENT DOCUMENTS

EP 1026288 A1 8/2000
GB 2291070 A 1/1996
JP 5202498 A 8/1993

* cited by examiner

*Primary Examiner* — Bruce Bell
(74) *Attorney, Agent, or Firm* — The Webb Law Firm

(57) ABSTRACT

An object of the present invention is to provide a production apparatus for electro-deposited metal foil or the like that can reduce thickness fluctuation of electro-deposited metal foil. To achieve the object, a production apparatus for electro-deposited metal foil or the like in which a cathode and an insoluble anode apart from each other, supplying an electrolytic solution through a gap between the cathode and the anode, making the cathode move along to the insoluble anode, electrodepositing a metal component on an electro-deposition surface of the moving cathode is applied. Wherein the insoluble anode is a thin plate insoluble metal electrode provided with a conductive electrode material coating layer on a surface of a substrate made of a corrosion-resistant material, and detachably mounted to an electrode base by using predetermined fixing means, and the conductive electrode material coating layer of the thin plate insoluble metal electrode is provided with a conductive electrode material stripped belt in a direction perpendicular to a moving direction of the cathode, and the fixing means is provided in the conductive electrode material stripped belt.

4 Claims, 9 Drawing Sheets

PRIOR ART

PRIOR ART

PRIOR ART

PRODUCTION APPARATUS FOR ELECTRO-DEPOSITED METAL FOIL, PRODUCTION METHOD OF THIN PLATE INSOLUBLE METAL ELECTRODE USED IN PRODUCTION APPARATUS FOR ELECTRO-DEPOSITED METAL FOIL, AND ELECTRO-DEPOSITED METAL FOIL PRODUCED BY USING PRODUCTION APPARATUS FOR ELECTRO-DEPOSITED METAL FOIL

TECHNICAL FIELD

The present invention relates to a production apparatus for electro-deposited metal foil, a production method of a thin plate insoluble metal electrode used in the production apparatus for electro-deposited metal foil, and an electro-deposited metal foil produced by using the production apparatus for electro-deposited metal foil. More particularly, the present invention relates to a production apparatus suitable for producing an electro-deposited metal foil produced as a long sheet-like product by continuous electrolysis.

BACKGROUND ART

Conventionally, among a technology for producing metal foil by a continuous electrolysis method, production of an electro-deposited copper foil that is a basic material for producing a printed-wiring board has been a typical technology. For example, in the apparatus for a continuous electrolysis of electro-deposited copper foil, a drum (cylindrical) cathode and an anode such as a lead alloy electrode made of an insoluble lead-silver alloy or the like.

The lead alloy electrode is acid resistant against to an acidic metal salt solution with high concentration such as a copper sulfate solution. Also, because the lead alloy electrode is composed of lead having a low melting point, it makes forming of a curving shape on anode surface to be faced along a shape of a surface of a drum cathode easy and also makes working at an installation site of an electrolysis apparatus. That is, the lead alloy electrode has been widely used because of excellent material workability which enables high operability.

However, with increasing size of the continuous electrolysis apparatus, it has been made difficult to obtain a uniform alloy composition in the same surface of the lead alloy electrode. Also, for the lead alloy electrode in a sulfuric acid base solution used as an electrolytic solution, deviations in alloy composition, a difference in crystal structure and the like between lots drastically affect polarization performance in electrolysis, and it has been made difficult to produce electro-deposited copper foil having high quality in an advanced technologies.

In addition, the lead alloy electrode is consumed in electrolysis to result deformation of a shape of an electrode surface easily, and maintenance costs are increased. Further, a lead component discharged according to the consumption of electrode into the electrolytic solution may form substances such as metal lead, lead ion, lead sulfate, or lead oxide. They may cause various defects in products when contaminated in the electro-deposited copper foil.

Thus, Japanese Patent Laid-Open No. 5-202498 discloses "an insoluble electrode structure in which a thin sheet insoluble metal electrode provided with a conductive electrode material which is mounted on at least a part of an electrolysis-side surface of a plate-like or curved electrode base is made detachable by mounting means such as a screw, and a surface of the electrode base in contact with the thin plate insoluble electrode is coated with a conductive electrode material." As is apparent from FIG. 1 disclosed in Japanese Patent Laid-Open No. 5-202498, the insoluble electrode structure that can be used as a production apparatus of electro-deposited copper foil is disclosed. The insoluble electrode structure has been a solution of the problems that occur in using of the above-described lead alloy electrode, and has increased production stability of the electro-deposited metal foil.

Patent Document 1: Japanese Patent Laid-Open No. 5-202498

However, even when the insoluble electrode structure disclosed in Japanese Patent Laid-Open No. 5-202498 is used in continuous production of electro-deposited metal foil; it could not always satisfy latest requirements for electro-deposited metal foil.

In particular, there arises a sincere requirement to reduce thickness fluctuation of electro-deposited copper foil. That is, for the electro-deposited copper foil, thinner electro-deposited copper foil with less thickness fluctuation has been required in terms of improvement in formation of a fine pitch circuit on a printed-wiring board produced by using the electro-deposited copper foil, working accuracy in thickness reduction of a multilayer printed-wiring board, and downsizing.

Thus, there has been a requirement for a production apparatus for electro-deposited metal foil that can reduce thickness fluctuation of electro-deposited metal foil such as electro-deposited copper foil, and an electro-deposited metal foil with less thickness fluctuation produced by using the production apparatus for electro-deposited metal foil.

SUMMARY OF THE INVENTION

The inventors of the present application have diligently studied to enable reduction of thickness fluctuation of electro-deposited metal foil by applying a production apparatus for electro-deposited metal foil described below. As a result, production of an electro-deposited metal foil with less thickness fluctuation can be achieved.

Production apparatus for electro-deposited metal foil: A production apparatus for electro-deposited metal foil according to the present invention is a production apparatus for electro-deposited metal foil to continuously produce metal foil by arranging a cathode and an insoluble anode apart from each other, supplying an electrolytic solution through a gap between the cathode and the anode, making the cathode move along to the insoluble anode, electrodepositing a metal component on an electro-deposition surface of the moving cathode, wherein the insoluble anode is a thin plate insoluble metal electrode provided with a conductive electrode material coating layer on a surface of a substrate made of a corrosion-resistant material, and detachably mounted to an electrode base by using predetermined fixing means, and the conductive electrode material coating layer of the thin plate insoluble metal electrode is provided with a conductive electrode material stripped belt in a direction perpendicular to a moving direction of the cathode, and the fixing means is provided in the conductive electrode material stripped belt.

The production apparatus for electro-deposited metal foil according to the present invention is preferable to comprise a cathode to be "a rotating drum cathode using a cylindrical drum surface as an electro-deposition surface", and a insoluble anode to be "insoluble anode has a curved facing surface that can be arranged with a predetermined distance apart along a shape of the surface of the drum cathode".

Production method of thin plate insoluble metal electrode: A production method of a thin plate insoluble metal electrode according to the present invention is characterized including a working process including Steps A to D below.

Step A: a step of preparing a substrate made of a corrosion-resistant material having a shape of an insoluble anode;

Step B: a step of forming a conductive electrode material coating layer on a surface of the prepared substrate made of a corrosion-resistant material;

Step C: a step of forming a conductive electrode material stripped belt in a direction perpendicular to a moving direction of a cathode in the conductive electrode material coating layer on a surface of the substrate with coating layer to obtain a substrate with patterned coating layer; and Step D: a step of forming fixing means for mounting the substrate with patterned coating layer to an electrode base in the conductive electrode material stripped belt in the substrate with patterned coating layer.

Electro-deposited metal foil: Electro-deposited metal foil according to the present invention is an electro-deposited metal foil in long sheet-like form produced by using a production apparatus for electro-deposited metal foil, wherein thickness fluctuation in the metal foil along transverse direction is in the range [average thickness]±[average thickness]× 0.005 μm.

ADVANTAGES OF THE INVENTION

The production apparatus for electro-deposited metal foil according to the present invention comprises a special surface shape on the surface of the insoluble anode which is the conductive electrode material stripped belt provided in the conductive electrode material coating layer, and the shape can drastically reduce thickness fluctuation of the electro-deposited metal foil. To prevent generation of an abnormal electric current in electrolysis, a certain specified production method is used in the process to provide the conductive electrode material stripped belt in the conductive electrode material coating layer of the thin plate insoluble metal electrode that constitutes the insoluble anode. Thus, the electro-deposited metal foil produced by using the production apparatus for electro-deposited metal foil according to the present invention has excellent thickness uniformity that cannot be achieved in the conventional electro-deposited metal foil.

MODE FOR CARRYING OUT THE INVENTION

Now, a production apparatus for electro-deposited metal foil, a production method of a thin plate insoluble metal electrode used in the production apparatus, and electro-deposited metal foil produced by using the production apparatus for electro-deposited metal foil according to the present invention will be described in order.

<Production Apparatus for Electro-Deposited Metal Foil>

A production apparatus for electro-deposited metal foil according to the present invention is a production apparatus for electro-deposited metal foil arranging a cathode and an insoluble anode apart from each other, supplying an electrolytic solution through a gap between the cathode and the anode, making the cathode move along to the insoluble anode, electrodepositing a metal component on an electrodeposition surface of the moving cathode, and produce metal foil continuously. More practically, an apparatus used for producing electro-deposited copper foil and the like.

The production apparatus for electro-deposited metal foil according to the present invention has a feature in a structure of an insoluble anode. The insoluble anode essentially is provided with a "thin plate insoluble metal electrode" and an "electrode base" to which the electrode is mounted. That is, common technical back grounds such as cabling for power supply, a special structure for matching operation circumstances or the like will not be herein described. Just the "thin plate insoluble metal electrode" and the "electrode base" will be described.

Figure 1:
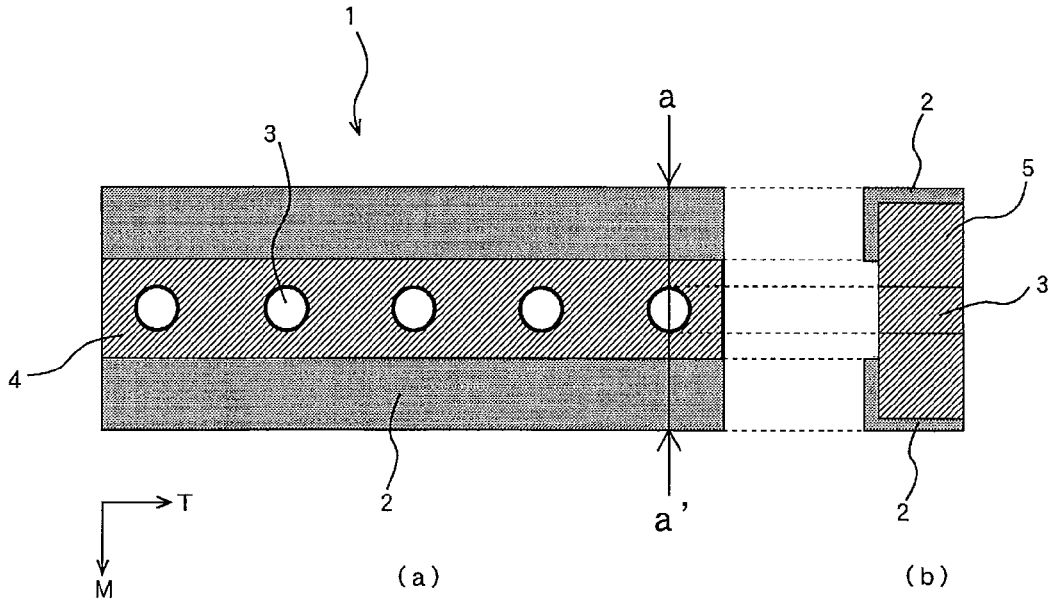
FIG. 1 is a schematic diagram showing an image of a thin plate insoluble metal electrode provided with a conductive electrode material coating layer used in a production apparatus for electro-deposited metal foil according to the present invention.
Figure 6:
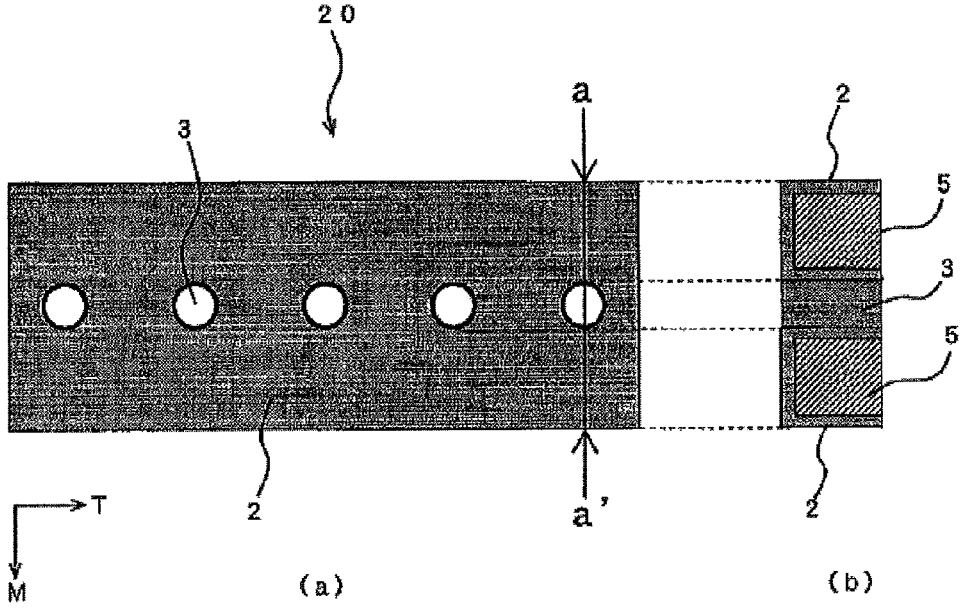
FIG. 6 is a schematic diagram showing an image of a thin plate insoluble metal electrode provided with a conductive electrode material coating layer used in a conventional production apparatus for electro-deposited metal foil.

Embodiment of a thin plate insoluble metal electrode: Descriptions will be made with reference to the drawings. FIG. 1 shows an image of a thin plate insoluble metal electrode 1 provided with a conductive electrode material coating layer 2 used in the present invention. FIG. 6 shows an image of a thin plate insoluble metal electrode 20 comprising a conventional conductive electrode material coating layer 2. FIGS. 1(*a*) and 6(*a*) are top views of the thin plate insoluble metal electrodes, and FIGS. 1(*b*) and 6(*b*) show cross-sectional views taken along the line a-a'.

First, with reference to FIG. 6, as is apparent from the drawing, in the conventional thin plate insoluble metal electrode 20, the electrode comprising the hole 3 for providing the fixing means (predetermined fixing means) for a screw or bolt is covered with the conductive electrode material coating layer 2 on both the surface and inside of the inner wall of the hole. The conductive electrode material coating layer is also provided on a top of the mounting hole on an electrode base (predetermined fixing means) for a screw or bolt used for mounting the thin plate insoluble metal electrode 20.

On the other hand, the thin plate insoluble metal electrode 1 used in the present invention is as shown in FIG. 1. In FIG. 1, the hole 3 for providing the fixing means (predetermined fixing means) of a screw or bolt, and is used for detachably mounting the thin plate insoluble metal electrode to an electrode base. The conductive electrode material coating layer 2 of the thin plate insoluble metal electrode 1 has a feature in that the conductive electrode material coating layer 2 is provided with a conductive electrode material stripped belt 4 in a direction T perpendicular to a moving direction M of a cathode, the fixing means (a hole 3) is provided in the conductive electrode material stripped belt 4, and an inner wall surface of the fixing means (a hole 3) provided is not covered with the conductive electrode material coating layer 2. In other words, it can be said that the thin plate insoluble metal electrode herein used is such that the conductive electrode material coating layer 2 is provided in a required area on a surface of a substrate 5 made of a corrosion-resistant material, the conductive electrode material stripped belt 4 is formed, and the fixing means (a hole 3) is provided in the conductive electrode material stripped belt 4. Thus, it can be understood that an electrode surface completely different from that of the conventional thin plate insoluble metal electrode 20 shown in FIG. 6 is prepared. Also, the conductive electrode material coating layer is not provided on a top of a screw or bolt (predetermined fixing means) used for mounting the thin plate insoluble metal electrode 1 to the electrode base.

By applying such a structure of the thin plate insoluble metal electrode 1, the conductive electrode material stripped belt 4 is made to be a region where polarization may not occur against to an electro-deposition surface of the cathode in electrolysis operation. Conventionally, between the fixing means (a hole 3) provided and the electro-deposition surface of the cathode, deviation in polarization was increased due to a shape of the fixing means (a hole 3), electro-deposition at the position where the fixing means (a hole 3) are provided is made hard to partially reduce a thickness of electro-deposited metal foil and affected in large thickness fluctuation. Thus, the present inventors have applied the structure of the thin plate insoluble metal electrode 1 as shown in FIG. 1 to reduce polarization deviation in the entire transverse direction of the fixing means position (a hole 3) provided. As a result, a area where electric current deviation between the position for providing the fixing means (a hole 3) is arranged and the electro-deposition surface of the cathode is reduced, thereby thickness fluctuation in the electro-deposited metal foil deposited on the electro-deposition surface of the cathode is drastically reduced in the same surface.

The substrate 5 made of a corrosion-resistant material used in the thin plate insoluble metal electrode used in the present invention is preferably made of a material selected from titanium, aluminum, chromium, and alloys thereof.

The "substrate" herein is supposed to be a plate-like material, and the plate shape does not strictly mean a flat "plate shape" but means a shape including a somewhat curved shape. This is because when the electrode is mounted to the electrode base described later, deformation for matching to a shape of an anode to be a certain curved shape is supposed. There is no particular limitation on a thickness, width, length, or the like of the substrate 5. This is because the thickness, width, length, or the like depend on a required size of the thin plate insoluble metal electrode and also a size of the production apparatus for electro-deposited metal foil.

As for the conductive electrode material coating layer 2 formed on the thin plate insoluble metal electrode used in the present invention, a known conductive electrode material may be applicable. For example, the conductive electrode material coating layer 2 is preferably made of a material such as platinum, a platinum-iridium alloy, a platinum-tantalum alloy, an iridium-tantalum alloy, a platinum-iridium-tantalum alloy, or a platinum-ruthenium alloy. It is because when the electrode is used as an anode in electrolysis with polarization, oxygen is generated. In such a case, an alloy composition of any of platinum-iridium, iridium-tantalum, and platinum-iridium-tantalum containing iridium oxide is preferably used to enable long-term operation.

The conductive electrode material stripped belt 4 formed in the thin plate insoluble metal electrode 1 used in the present invention is a region without the conductive electrode material coating layer 2. Thus, in this region, a passivated surface of the substrate 5 made of a corrosion-resistant material is exposed, and polarization may hardly occur between the region and the electro-deposition surface of the cathode. The conductive electrode material stripped belt 4 is formed into a shape suitable for the production apparatus for electro-deposited metal foil in which the cathode moves along to the insoluble anode, and a metal component is electrodeposited on an electro-deposition surface of the moving cathode with a uniform thickness. That is, the conductive electrode material coating layer 2 of the thin plate insoluble metal electrode 1 provided with the conductive electrode material stripped belt 4 in the direction perpendicular to the moving direction M of the cathode, and the position for providing the fixing means (a hole 3) is arranged in the conductive electrode material stripped belt 4, and the inner wall surface of the position for providing the fixing means (a hole 3) arranged is not covered with the conductive electrode material coating layer 2 also. According to such a shape, thickness fluctuation along the moving direction (M) of the produced electro-deposited metal foil is not affected, and simultaneously, thickness fluctuation along the transverse direction (T) can be drastically reduced.

The conductive electrode material stripped belt 4 preferably has a width in the moving direction (M) of 35 mm or less. The conductive electrode material stripped belt 4 is provided in the entire transverse direction (T) of the anode, and if the width in the moving direction (M) exceeds 35 mm, an electro-deposition area is reduced and result poor industrial productivity. Also, the change of flow state of the electrolytic solution in this region supplied from an inlet between the moving cathode and the insoluble anode may change in this region to vary a metal ion supply locally depending on positions and make uniform electrolysis hard. Further, the conductive electrode material stripped belt 4 is preferably 30% or less of the electrode surface area of the insoluble anode. When exceeding 30%, productivity may not satisfy industrial productivity.

Figure 2:
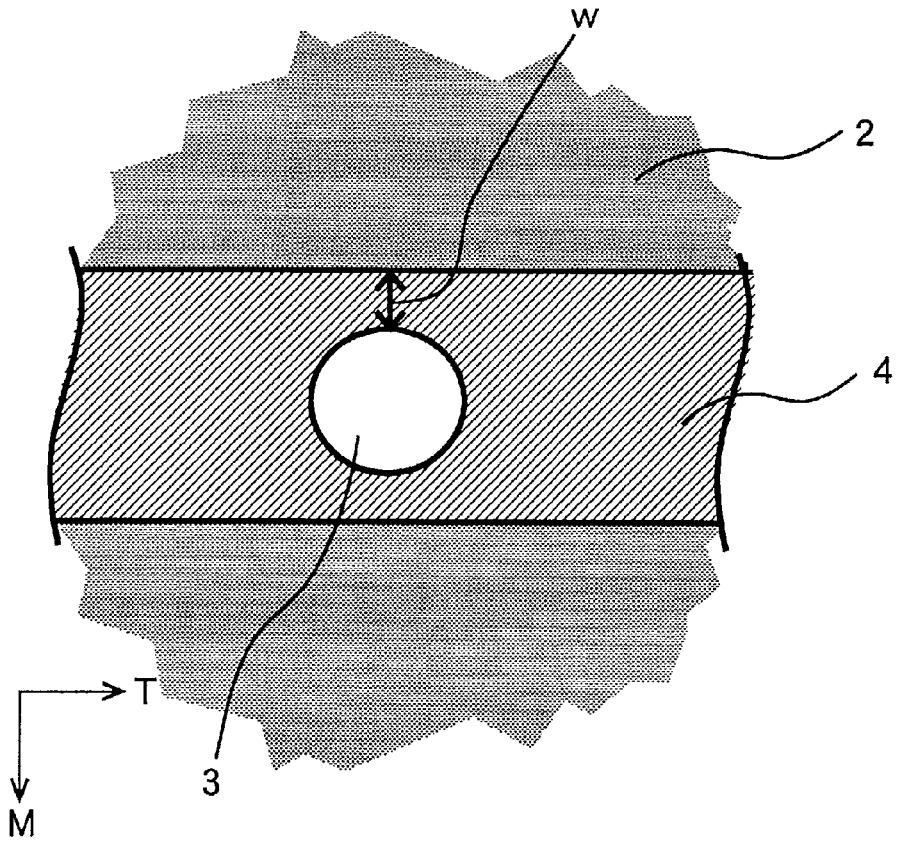
FIG. 2 is an enlarged schematic diagram of a periphery of a hole for showing a positional relationship between a width of a conductive electrode material stripped belt in a moving direction (M) of the cathode and the hole in the conductive electrode material stripped belt.

The position for providing the fixing means (a hole 3) is arranged in the conductive electrode material stripped belt 4. Thus, the conductive electrode material coating layer 2 does not exist on an outer periphery and the inner wall surface of the position for providing the fixing means (a hole 3) arranged, and deviation in the polarization state in the thin plate insoluble metal electrode can be prevented as much as possible. Further, as is apparent from FIG. 2, a positional relationship between the width in the moving direction (M) of the conductive electrode material stripped belt 4 and the hole 3 is important in view of the electrolytic solution flow. A gap W shown in FIG. 2 is preferred to be 1 mm or more. This is because when a state where a screw or bolt (predetermined fixing means) is inserted into the hole 3 to fix the electrode 1 to the electrode base is considered, a head of the screw or bolt (predetermined fixing means) exists on the surface, and has a different shape from the surface with the conductive electrode material coating layer 2 however flat the head is designed. As a result, when the gap W is less than 1 mm, electrolytic solution flow might be changed around the hole 3 (predetermined fixing means) where the screw or bolt is inserted.

The thickness of the thin plate insoluble metal electrode described above is preferably 0.5 mm to 2.0 mm, and more preferably 0.5 mm to 1.5 mm in view of material workability. The thickness of the thin plate insoluble metal electrode less than 0.5 mm causes ununiform electric current distribution in polarization, increases bendability due to the less thickness, and poor material workability. On the other hand, when the thickness of the thin plate insoluble metal electrode is more than 2 mm, it may require long operation time for thermal decomposition for a conductive electrode material solution after coating. Also, when the thin plate insoluble metal electrode is mounted to a curved surface of a metal base, fixing at mounting of the electrode along the curved surface of the electrode base is difficult, and the bending process for the thin plate insoluble metal electrode may be required for forming the curved shape, which is not preferable.

As described above, when the electrolytic solution is made pass through the gap between the cathode and the insoluble anode, the cathode rotates along to the insoluble anode and the metal component is electro-deposited on the electro-deposition surface of the moving cathode with a uniform thickness, the electro-deposited metal foil having the thickness fluctuation drastically reduced in the moving direction (M) and the transverse direction (T) can be continuously produced.

Embodiment of an electrode base: The "electrode base" in the present invention is a support base to which the "thin plate insoluble metal electrode" described above is detachably mounted by using a screw or bolt (predetermined fixing means).

There is no particular limitation on a shape, size, material or the like of the electrode base. Just required is that the electrode base is provided with a rod receiving hole that can accept and fix a rod of the screw or bolt (predetermined fixing means) for mounting the "thin plate insoluble metal electrode" as an essential structure.

<Embodiment of Production Apparatus for Electro-Deposited Metal Foil>

An embodiment of the cathode and the insoluble anode used in combination for producing electro-deposited metal foil will be described as an Example. The production apparatus for electro-deposited metal foil described below is suitable for producing a long sheet-like product such as electro-deposited copper foil or electro-deposited nickel foil.

Rotating drum cathode: For a cathode of a production apparatus for electro-deposited metal foil 30 in the present invention, a rotating drum cathode using a cylindrical drum surface as an electro-deposition surface is used. A shape of the rotating drum cathode 10 is apparent from diagonally seen in FIG. 4. The rotating drum cathode 10 rotates with a supported rotating shaft 11, a drum surface 12 is made to move along to the insoluble anode, the drum surface 12 of the rotating drum cathode 10 is used as an electro-deposition surface for a metal component, a metal film electro-deposited on the drum surface 12 is continuously peeled, and the metal film as electro-deposited metal foil is produced. The drum surface 12 of the rotating drum cathode 10 is generally made of titanium or chromium-plated stainless steel. The insoluble anode described below will be arranged against to the drum surface 12 of the rotating drum cathode.

Figure 3:
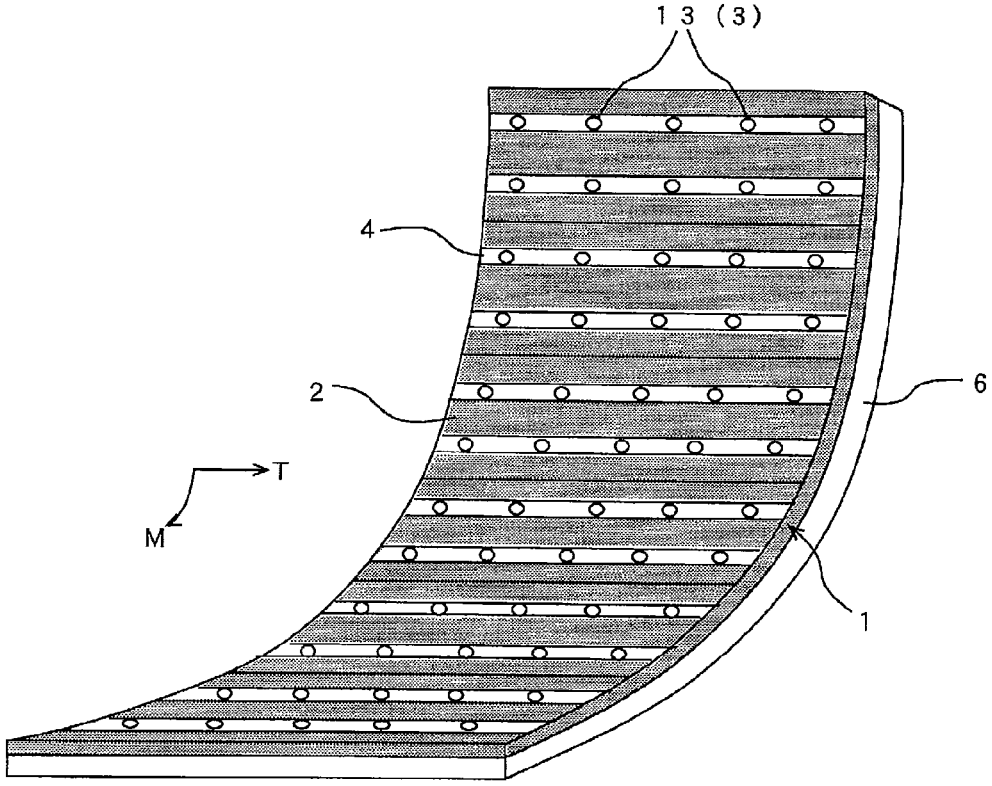
FIG. 3 is a schematic diagram showing a shape of an insoluble anode having a curved facing surface which is arranged to face a rotating drum cathode of the production apparatus for electro-deposited metal foil.

Insoluble anode: The anode of the production apparatus for electro-deposited metal foil 30 in the present invention is an insoluble anode, and is required to be arranged with a certain distance apart from and along the shape of the drum surface 12 of the rotating drum cathode 10. Thus, as shown in FIG. 3, the anode is required to have a curved facing surface (thin plate insoluble metal electrode surface). At this time, the conductive electrode material stripped belt 4 is provided in the transverse direction (T) on the surface of the thin plate insoluble metal electrode 1 that constitutes the curved facing surface, and a screw or bolt (predetermined fixing means) 13 (corresponding to the position of the hole 3) is inserted into the hole 3 provided in the conductive electrode material stripped belt 4 to fix the electrode 1 to the electrode base 6.

The conductive electrode material coating layer 2 is provided with the conductive electrode material stripped belt 4 in the direction T perpendicular to the moving direction M of the cathode, and is provided with the position for providing the fixing means (a hole 3) arranged in the conductive electrode material stripped belt. The inner wall surface of the position for providing the fixing means (a hole 3) is not covered with the conductive electrode material coating layer 2. Such a shape may not affect on thickness fluctuation along the moving direction (M) of the produced electro-deposited metal foil, and simultaneously, thickness fluctuation along the transverse direction (T) can be drastically reduced.

Arrangement of rotating drum cathode and insoluble anodes: As shown by the arrow in FIG. 4, the rotating drum cathode 10 is arranged in a housing space formed by two insoluble anodes, and the thin plate insoluble metal electrodes 1 of the insoluble anodes are set to have a certain distance apart from the drum surface 12 of the rotating drum cathode 10. An electrolytic solution is supplied from a bottom of the housing space formed by the two insoluble anodes, the rotating drum cathode 10 is polarized with rotation, and the metal film is electro-deposited on the rotating drum cathode 10 to be continuously peeled and wound. The production apparatus for electro-deposited metal foil 30 with such a construction is particularly useful in the production field of electro-deposited copper foil.

Embodiment of production of thin plate insoluble metal electrode: a production method of the thin plate insoluble metal electrode 1 provided with the conductive electrode material coating layer used in the production apparatus for electro-deposited metal foil described above will be demonstrated. Now, a working process including Steps A to D will be described in order with reference to FIG. 5.

Step A: In the step A, a substrate 5 made of a corrosion-resistant material having a shape matching to an insoluble anode shape is prepared. This step corresponds to FIG. 5(*a*). The substrate 5 herein is preferably made of a corrosion-resistant material such as a titanium plate. A thickness of a finally produced thin plate insoluble metal electrode 1 is preferably 0.5 mm to 2.0 mm.

Step B: In the step B, a conductive electrode material coating layer 2 is formed on a surface of the prepared substrate 5 made of a corrosion-resistant material to form a substrate with coating layer 40. This step corresponds to FIG. 5(*b*). In forming of the conductive electrode material coating layer 2, activation such as alkaline degreasing or acid pickling of the surface of the substrate 5 is conducted. Then, when an iridium-tantalum alloy is used for the conductive electrode material coating layer 2, a conductive electrode material solution composed of iridium chloride and tantalum chloride in diluted hydrochloric acid is coated on the surface of the substrate, and baked at 450° C. to 550° C. for 10 to 30 minutes. The coating and baking are repeated again and again, and a conductive electrode material coating layer 2 having an intended thickness is formed on the surface of the substrate 5 to obtain a substrate with coating layer 40.

Step C: In the step C, the conductive electrode material coating layer 2 on the surface of the substrate with coating layer 40 is partially stripped to form a conductive electrode material stripped belt 4 in a direction perpendicular to a moving direction of a cathode to form a substrate with patterned coating layer 50. This step corresponds to FIG. 5(*c*). The conductive electrode material coating layer 2 is partially stripped by physical polishing, grinding or milling. There is no particular limitation on a polishing or grinding method. Any physical working method may be used as long as a component of a conductive electrode material does not remain on the conductive electrode material stripped belt 4.

Step D: In the step D, fixing means for mounting to an electrode base is formed in the conductive electrode material stripped belt 4 in the substrate with patterned coating layer 50. This step corresponds to FIG. 5(*d*). There is no particular limitation on the fixing means. For example, the hole 3 into which a screw or bolt is inserted for fixing to the electrode base is formed in the conductive electrode material stripped belt 4 to obtain the thin plate insoluble metal electrode 1 provided with the conductive electrode material coating layer 2.

For the thin plate insoluble metal electrode 1 provided with the conductive electrode material coating layer 2 produced by the above-described steps, the conductive electrode material does not remain on the periphery and the inner wall surface of the hole 3 arranged in the conductive electrode material stripped belt 4 and into which the screw or bolt is inserted. Thus, no undesirable electric current is generated through the periphery and the inner wall surface of the hole 3, and the thickness of the electro-deposited metal foil is not affected, thereby an electro-deposited metal foil with a uniform thickness can be produced.

Embodiment of electro-deposited metal foil: Electro-deposited metal foil according to the present invention is long sheet-like form metal foil produced by using the production apparatus for electro-deposited metal foil described above. The electro-deposited metal foil has a feature in that thickness fluctuation in the metal foil along transverse direction is in the range [average thickness]±[average thickness]×0.005 μm. The thickness fluctuation refers to thicknesses when measured by an eddy-electric current thickness gauge, which can be determined from a thickness chart obtained by line-scanning in the transverse direction of the electro-deposited metal foil. For the electro-deposited metal foil produced by the conventional production method, the thickness fluctuation in the metal foil along transverse direction might be in the range [average thickness]±[average thickness]×0.1 μm.

Example

Figure 4:
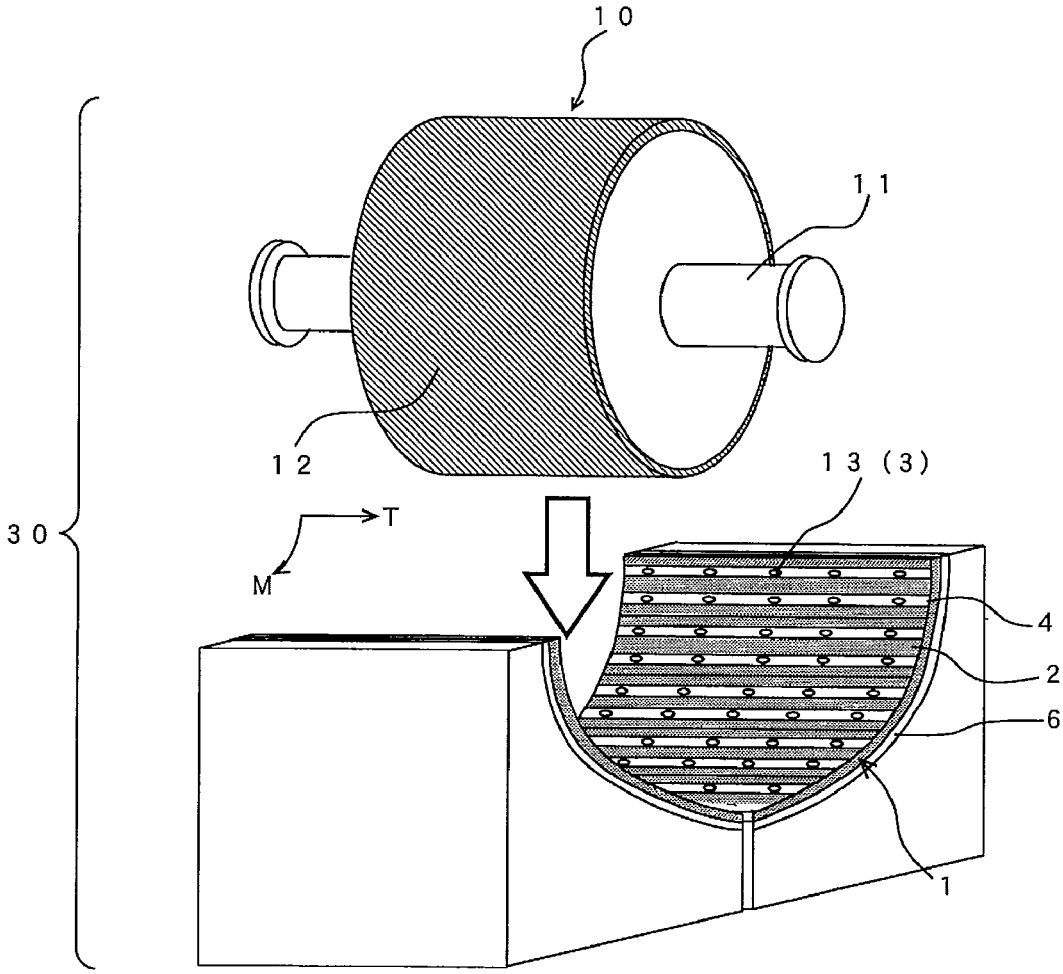
FIG. 4 is a conceptual view for illustrating arrangement of the rotating drum cathode and the insoluble anode that constitute the production apparatus for electro-deposited metal foil.

In the Example, a thin plate insoluble metal electrode 1 described below was prepared and used as the insoluble anode of the production apparatus for electro-deposited metal foil shown in FIG. 4, polarization and electrolysis was performed in a static state without rotating a rotating cathode drum to produce electro-deposited copper foil, and thickness fluctuation along a transverse direction was measured.

Production of thin plate insoluble metal electrode: In the production of the thin plate insoluble metal electrode 1 in the Example, the working process including Steps A to D shown in FIG. 5 was conducted. Each step will be described one by one.

Step A: A titanium plate having a length of 1.5 m, a width of 30 cm, and a thickness of 1 mm having a shape matching to the insoluble anode shape was prepared as a substrate 5.

Step B: The titanium plate was pretreated and activated. Meanwhile, iridium chloride and tantalum chloride were dissolved in diluted hydrochloric acid so that the weight ratio of iridium and tantalum was 7:3 to prepare a conductive electrode material solution. Then, the conductive electrode material solution was coated on the activated titanium plate, and baked at 490° C. for 15 minutes in the atmosphere. The operation above was repeated 15 times, and an iridium-tantalum alloy coating was formed as a conductive electrode material coating layer 2 on a surface of the titanium plate as the substrate to obtain a substrate with coating layer 40.

Step C: The substrate with coating layer 40 was milled by using an end mill to obtain a conductive electrode material stripped belt 4 having a width of 22 mm and a length of 1.5 m to prepare a substrate with patterned coating layer 50.

Figure 5:
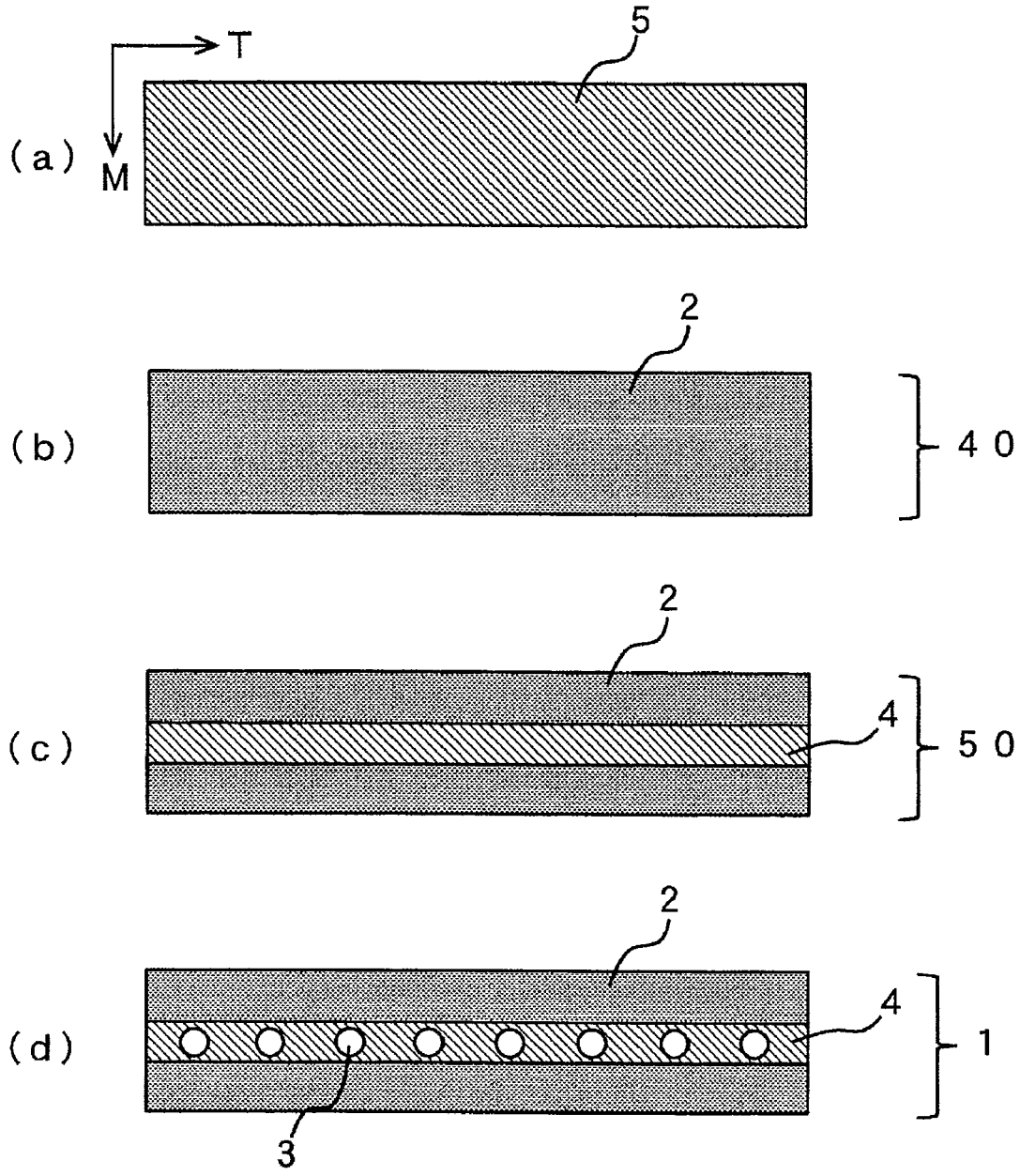
FIG. 5 is a conceptual view for illustrating a production flow of a thin plate insoluble metal electrode used in the production apparatus for electro-deposited metal foil according to the present invention.

Step D: In the conductive electrode material stripped belt 4 in the substrate with patterned coating layer 50, as shown in FIG. 5(*d*), the hole 3 (outer diameter of 18 mm) into which an electrode mounting screw can be inserted was provided as fixing means for mounting to an electrode base to obtain a thin plate insoluble metal electrode 1 provided with the conductive electrode material coating layer 2.

Construction of production apparatus for electro-deposited metal foil: The thin plate insoluble metal electrode 1 prepared as described above was used as an anode of an electro-deposited copper foil production apparatus. A rotating drum cathode of the electro-deposited copper foil production apparatus in the Example has a diameter of 3 m and a width of 1.5 m, and is provided with a drum surface as an electro-deposition surface made of titanium. An insoluble anode to be arranged apart (distance between electrodes: 20 mm) along a lower shape of the rotating drum cathode was finished by fixing the thin plate insoluble metal electrode 1 on an electrode base 6, a titanium plate having a thickness of 25 mm by the electrode mounting screw 13.

Static electrolysis test: To investigate thickness fluctuation of the electro-deposited copper foil produced by using the above-described electro-deposited copper foil production apparatus in the transverse direction, electrolysis was conducted with the rotating drum cathode without rotating to produce electro-deposited copper foil having an average thickness of about 35 μm. Then, the thickness in the transverse direction of the electro-deposited copper foil was measured by using an X-ray thickness gauge produced by FUTEC INC. As a result, an average thickness of 38.1±0.15 μm was obtained, and a thickness chart in the transverse direction shown in FIG. 8 was obtained. As a copper electrolytic solution in the Example, a sulfuric acid base copper electrolytic solution with a copper concentration of 80 g/l, a free sulfuric acid concentration of 140 g/l, a chlorine concentration of 25 mg/l, a bis-(3-sulfopropyl)-disulfide of 5 mg/l, and diallyldimethyl ammonium chloride polymer of 30 mg/l was used to conduct electrolysis at a solution temperature of 50° C. and an electric current density of 50 A/dm$^2$.

Comparative Example

In the Comparative Example, a thin plate insoluble metal electrode 20 described below was prepared and used as the insoluble anode of the production apparatus for electro-deposited metal foil shown in FIG. 4 as in the Example. Polarization and electrolysis was conducted in a static state without rotation of a rotating cathode drum to produce electro-deposited copper foil, and thickness fluctuation along a transverse direction was measured.

Production of thin plate insoluble metal electrode: The thin plate insoluble metal electrode 20 in the Comparative Example was produced by a working process including Steps I to III described below. Now, each step will be described one by one.

Step I: A titanium plate having a length of 1.5 m, a width of 30 cm, and a thickness of 1 mm having a shape matching to the insoluble anode shape was prepared as a substrate 5.

Step II: The hole 3 (outer diameter of 18 mm) into which an electrode mounting screw can be inserted was provided in the titanium plate as fixing means for mounting to an electrode base.

Step III: The titanium plate was pretreated and activated. Then, as in the Example, an iridium-tantalum alloy coating was formed as a conductive electrode material coating layer on both a surface of the titanium plate as the substrate and an inner wall portion of the hole to obtain the thin plate insoluble metal electrode 20 provided with the conductive electrode material coating layer 2 as shown in FIG. 6.

Figure 7:
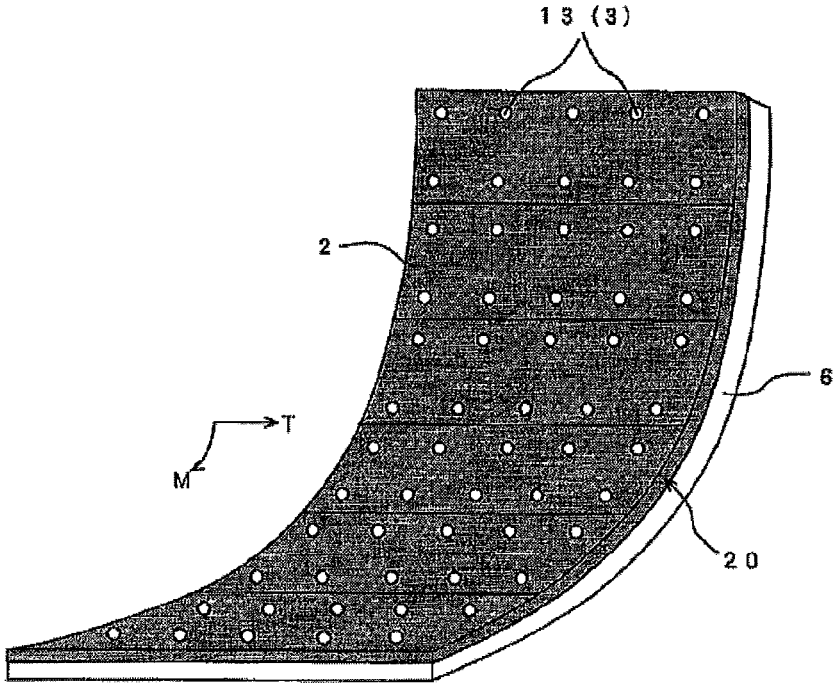
FIG. 7 is a conceptual view showing a shape of an insoluble anode when the conventional thin plate insoluble metal electrode is used as an anode of an electro-deposited copper foil production apparatus.

Construction of production apparatus for electro-deposited metal foil: The thin plate insoluble metal electrode 20 prepared as described above was used as an anode of an electro-deposited copper foil production apparatus. A rotating drum cathode in the electro-deposited copper foil production apparatus in the Comparative Example is the same as in the Example. Instead of the thin plate insoluble metal electrode 1 used in the Example, the thin plate insoluble metal electrode 20 was fixed to an electrode base 6 as in the Example by an electrode mounting screw 13 to be a state shown in FIG. 7.

Static electrolysis test: To investigate thickness fluctuation of the electro-deposited copper foil produced by using the above-described electro-deposited copper foil production apparatus in the transverse direction, electrolysis was performed with the rotating drum cathode being still to produce electro-deposited copper foil having an average thickness of about 35 μm. As a result, an average thickness of 38.2±0.4 μm was obtained from measurement in the same manner as in the Example, and a thickness chart in the transverse direction shown in FIG. 9 was obtained.

Comparison Between Example and Comparative Example

Figure 8:
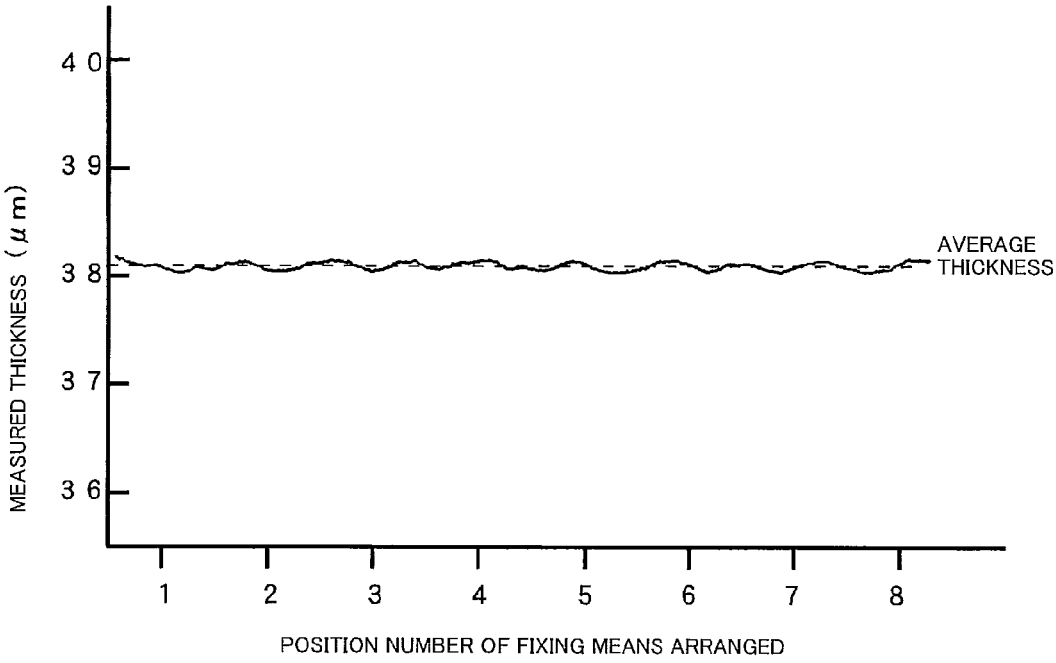
FIG. 8 is a thickness distribution chart in transverse direction to examine thickness fluctuation in an electro-deposited copper foil obtained in an Example along a transverse direction.
Figure 9:
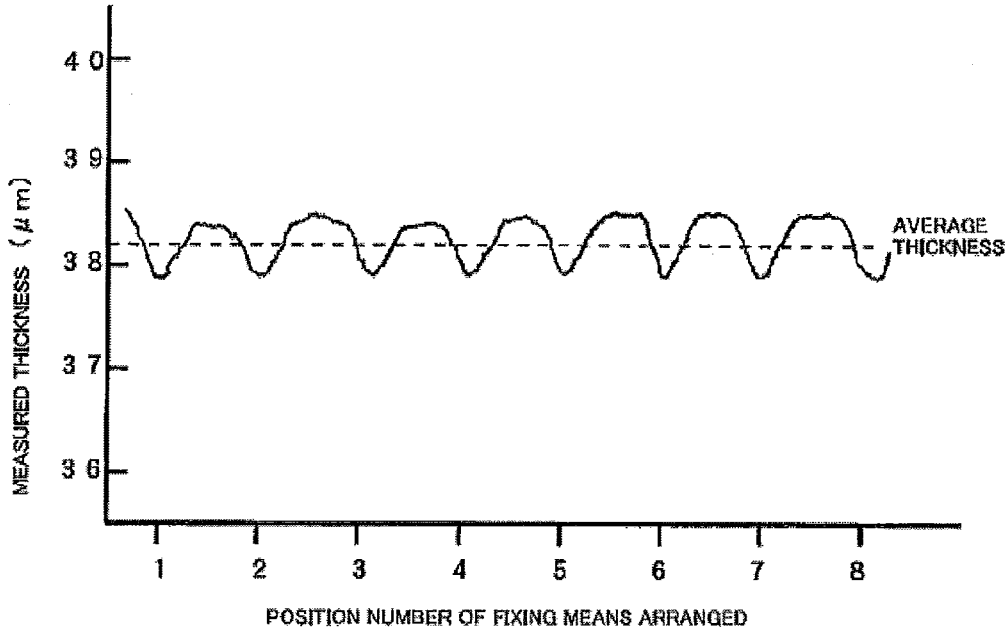
FIG. 9 is a thickness distribution chart in transverse direction for observing thickness fluctuation in an electro-deposited copper foil obtained in a Comparative Example along transverse direction.

Comparison between FIGS. 8 and 9 shows a difference between the Example and the Comparative Example clearly. Since both edges in the transverse direction of the electro-deposited copper foil are generally trimmed from a product, comparison is made within an effective width as a product obtained by the Example and the Comparative Example.

In the Example, the average thickness is 38.1±0.15 μm, which satisfies the condition of [average thickness]±[average thickness]×0.005 μm. On the other hand, in the Comparative Example, the average thickness is 38.2±0.4 μm, which does not satisfy the condition of [average thickness]±[average thickness]×0.005 μm.

Therefore, it can be understood that the production apparatus for electro-deposited metal foil according to the present invention can be used to effectively reduce thickness fluctuation of the electro-deposited metal foil in the transverse direction.

INDUSTRIAL APPLICABILITY

The production apparatus for electro-deposited metal foil according to the present invention drastically reduces thickness fluctuation of the produced electro-deposited metal foil, and can provide electro-deposited metal foil with a uniform thickness. Thus, for metal foil to be etched, for example, for electro-deposited copper foil used in a printed-wiring board, etching accuracy can be improved, and deviation of accuracy in an etched circuit at positions is reduced, so it is preferable.

In the present invention, the special surface shape comprising the conductive electrode material stripped belt is provided in the conductive electrode material coating layer on the surface of the insoluble anode of the production apparatus for electro-deposited metal foil. However, the shape can be formed by a conventional technology without a special working method in low production costs.

DESCRIPTION ON SYMBOLS

1 thin plate insoluble metal electrode
2 conductive electrode material coating layer
3 hole (predetermined fixing means)
4 conductive electrode material stripped belt
5 substrate
6 electrode base
10 rotating drum cathode
11 rotating shaft
12 drum surface
13 screw or bolt (predetermined fixing means)
20 conventional thin plate insoluble metal electrode
30 production apparatus for electro-deposited metal foil
40 substrate with coating layer
50 substrate with patterned coating layer

What is claimed is:

1. A production apparatus for electro-deposited metal foil to continuously produce metal foil by arranging a cathode and an insoluble anode apart from each other, supplying an electrolytic solution through a gap between the cathode and the anode, making the cathode move along to the insoluble anode, electrodepositing a metal component on an electro-deposition surface of the moving cathode, wherein the insoluble anode is a thin plate insoluble metal electrode provided with a conductive electrode material coating layer on a surface of a substrate made of a corrosion-resistant material, and detachably mounted to an electrode base by using predetermined fixing means, and the conductive electrode material coating layer of the thin plate insoluble metal electrode is provided with a conductive electrode material stripped belt in a direction perpendicular to a moving direction of the cathode, and the fixing means are provided in the conductive electrode material stripped belt.

2. The production apparatus for electro-deposited metal foil according to claim 1, wherein the conductive electrode material stripped belt is a region in which the conductive electrode material coating layer of the thin plate insoluble metal electrode is stripped in a belt shape 1 mm or more wider than the fixing means.

3. The production apparatus for electro-deposited metal foil according to claim 1, comprising a cathode and an insoluble anode used in combination for producing electro-deposited metal foil, wherein the cathode is a rotating drum cathode using a cylindrical drum surface as an electro-deposition surface, and the insoluble anode has a curved facing surface that can be arranged with a predetermined distance apart along a shape of the surface of the drum cathode.

4. A production method of a thin plate insoluble metal electrode provided with a conductive electrode material coating layer used in a production apparatus for electro-deposited metal foil according to claim 1, including a working process comprising:

Step A: a step of preparing a substrate made of a corrosion-resistant material having a shape of an insoluble anode;

Step B: a step of forming a conductive electrode material coating layer on a surface of the prepared substrate to obtain a substrate with coating layer;

Step C: a step of forming a conductive electrode material stripped belt in a direction perpendicular to a moving direction of a cathode in the conductive electrode material coating layer on a surface of the substrate with coating layer to obtain a substrate with patterned coating layer; and Step D: a step of forming fixing means for mounting the substrate with patterned coating layer to an electrode base in the conductive electrode material stripped belt in the substrate with patterned coating layer.

* * * * *